US007567897B2

(12) United States Patent
Halcrow et al.

(10) Patent No.: US 7,567,897 B2
(45) Date of Patent: Jul. 28, 2009

(54) METHOD FOR DYNAMIC SELECTION OF OPTIMIZED CODEC FOR STREAMING AUDIO CONTENT

(75) Inventors: Michael Austin Halcrow, Pflugerville, TX (US); Dustin C. Kirkland, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 708 days.

(21) Appl. No.: 10/916,977

(22) Filed: Aug. 12, 2004

(65) Prior Publication Data

US 2006/0036436 A1 Feb. 16, 2006

(51) Int. Cl.
*G10L 19/00* (2006.01)
*G10L 21/00* (2006.01)

(52) U.S. Cl. ..... 704/201; 704/270; 704/501

(58) Field of Classification Search ..... 704/230
See application file for complete search history.

(56) References Cited

U.S. PATENT DOCUMENTS

| | | | | |
|---|---|---|---|---|
| 5,115,469 | A * | 5/1992 | Taniguchi et al. | 704/228 |
| 5,546,395 | A * | 8/1996 | Sharma et al. | 370/468 |
| 5,978,783 | A * | 11/1999 | Meyers et al. | 706/21 |
| 6,718,183 | B1 * | 4/2004 | Blust et al. | 455/560 |
| 6,735,567 | B2 * | 5/2004 | Gao et al. | 704/258 |
| 7,185,240 | B2 * | 2/2007 | Saito et al. | 714/700 |
| 2003/0084277 | A1 * | 5/2003 | Przywara et al. | 713/1 |
| 2003/0202589 | A1 * | 10/2003 | Reitmeier et al. | 375/240.12 |
| 2006/0002572 | A1 * | 1/2006 | Smithers et al. | 381/104 |

* cited by examiner

*Primary Examiner*—David R Hudspeth
*Assistant Examiner*—Brian L Albertalli
(74) *Attorney, Agent, or Firm*—Dillon & Yudell LLP

(57) ABSTRACT

Several encoders at a broadcast system encode the same audio content. Packets from the resulting streams are immediately decoded and compared against the packets of the original audio stream. The broadcast system dynamically selects the codec that performs the best for the audio in any given packet. The packet produced by the encoder of the best-performing codec devices is selected to be broadcasted/transmitted.

23 Claims, 6 Drawing Sheets

METHOD FOR DYNAMIC SELECTION OF OPTIMIZED CODEC FOR STREAMING AUDIO CONTENT

BACKGROUND OF THE INVENTION

1. Technical Field

The present invention relates generally to audio content and more specifically to transmission of audio content. Still more particularly, the present invention relates to selection of an optimized codec for audio content.

2. Description of the Related Art

Technology for transmission of audio content in conventional media (e.g., radio and television) is known in the art. In addition to these conventional media, transmission of audio content via the Internet is quickly growing in popularity. With each conventional media, audio transmission is constrained by two key variables/parameters: (1) available bandwidth; and (2) quality of encoding/decoding (codec) processing. Selected codec is often influenced by the desire to minimize the bandwidth required for transmission while maximizing the quality of the transmitted content.

Available bandwidth is typically a static quantity, and codecs are designed to transmit content within pre-set maximum bandwidths. Thus, for the most part, codec quality differentiates the transmission and is the primary consideration influencing the types of devices (encoders, decoders, transmitters, etc.) and processes utilized at the broadcasting and receiving ends of the transmission. Codec is itself constrained by the type/makeup of content being transmitted. In audio content, for example, there are two distinct types of data signals, traditional voice signal (human voices) and non-voice signals, such as music/musical instruments, etc. While it is likely that audio content may consists primarily of one type of signal, it is quite common for audio content to include both types of signals within a single audio stream. Notably, from a codec analysis, each signal type has distinct characteristics/qualities that respond better to specific codec processing. Also, codec processing utilized for voice signals may not be appropriate (i.e., less ideal) for non-voice signals.

Thus, several different types of audio encoders and decoders have been created, some of which are designed to support a preferred type of audio content. One commonly utilized group of codec devices are the "Ogg" family of encoders and decoders (within the Ogg container). The Ogg container is able to encapsulate arbitrary audio codecs. The "Ogg Vorbis" audio codec performs well and is commonly utilized for general purpose audio content, including both voice and music. Features of Ogg Vorbis codec are described at worldwide web site "xiph.org/ogg/vorbis/". "Ogg Speex", in contrast, is optimized for the human voice alone and does not perform well for general purpose audio content. When encoding only voice content, Ogg Speex codec provides the best codec processing from a quality and bandwidth standpoint. Ogg Speex codec is described at world-wide web site "speex.org".

Conventional audio broadcast solutions constrains the broadcaster to only one codec per broadcast stream, even though different audio codecs perform better for different types of audio content. When selecting an audio codec for the content to be streamed over the Internet, radio stations that broadcast both talk programs and music currently select the most general purpose codec (e.g., Ogg Vorbis codec). As a result, both music and voice content is brought to a lowest common denominator of quality.

SUMMARY OF THE INVENTION

Disclosed is a method and system for separating audio content into constituent parts and processing each constituent part via a most optimal codec (among several available codecs) for that constituent part during transmission of the audio stream from a broadcast system to a receiver system. Streaming audio content is divided into its constituent packets at the broadcast system. The broadcast system is configured with multiple codec pairs that each process a copy of the packets within an audio stream and forwards the processed (encoded and decoded) packets to a comparator. The comparator first determines the quality of each processed packet and then selects the most optimal codec on a packet-by-packet basis by comparing codec quality against required bandwidth.

A copy of the encoded packet from the encoder of the codec devices determined to provide the most optimal codec is queued for transmission to the receiver system. The receiver system includes a set of similar decoders to the decoders of the codec devices at the broadcast system. Packets are routed to their respective decoder corresponding to the encoder of the most optimal codec devices. The packets are then reassembled into the audio content at the receiver system.

The above as well as additional objectives, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF AN ILLUSTRATIVE EMBODIMENT

The present invention provides a method and system for separating audio content into constituent parts and processing each constituent part via a most optimal codec (among several available codecs) for that constituent part during transmission of the audio stream from a broadcast system to a receiver system. Streaming audio content is divided into its constituent packets at the broadcast system. The broadcast system is configured with multiple codec pairs that each process a copy of the packets within an audio stream and forwards the processed (encoded and decoded) packets to a comparator. The comparator first determines the quality of each processed packet and then selects the most optimal codec on a packet-by-packet basis by comparing codec quality against required bandwidth.

A copy of the encoded packet from the encoder of the codec devices determined to provide the most optimal codec is queued for transmission to the receiver system. The receiver system includes a set of similar decoders to the decoders of the codec devices at the broadcast system. Packets are routed to their respective decoder corresponding to the encoder of the most optimal codec devices. The packets are then reassembled into the audio content at the receiver system.

Figure 1A:
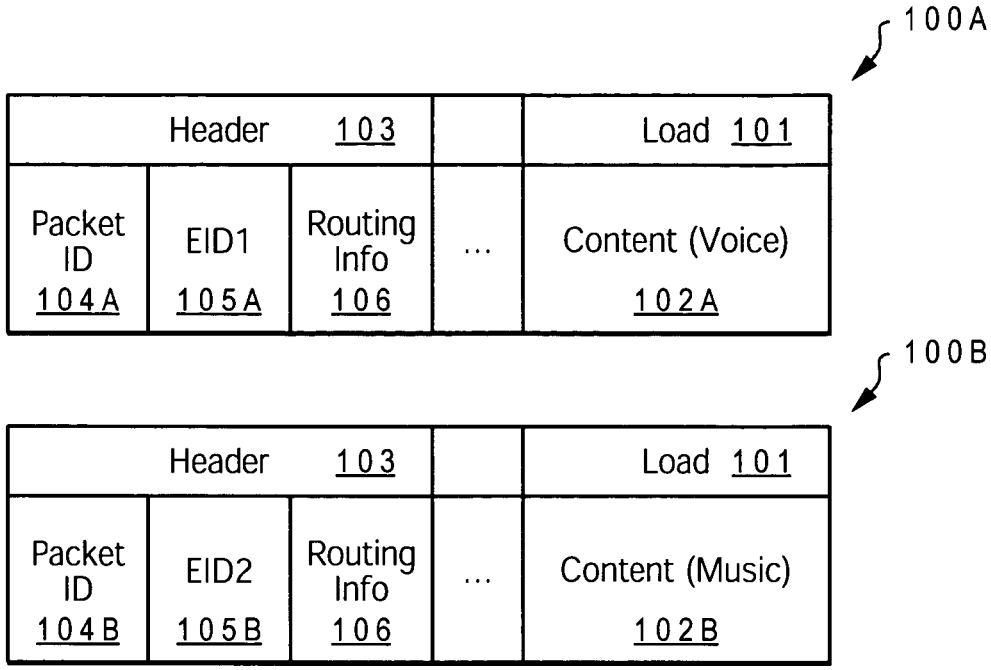
FIG. 1A illustrates exemplary audio packets with codec specified within the header information in accordance with one implementation of the invention.

With reference now to the figures, and in particular to FIG. 1A, there are illustrated sample packets of an audio stream. Two types of packets are illustrated, both having a load/content portion 101 and header portion 103. Load portion 101 contains the specific audio data signals that are being transmitted. These are illustrated as voice content 102A and music content 102B. Header portion 103 comprises several blocks of information encapsulated within the packet to enable the transmission and other functions of the packet. Including among these information blocks are packet ID 104A and 104B, routing information 106, and codec type 105A and 105B. According to the illustrative embodiment, codec type 105A and 105B indicates the most optimal codec selected for the respective packet. Notably, codec type 105A and 105B are different since the top packet 100A carries voice content that utilizes a different optimal codec process from the music content carried by the bottom packet 100B. The configuration of the packets and illustration of specific blocks of information encapsulated therein are for illustration only and not meant to imply any limitations on the invention.

Figure 2A:
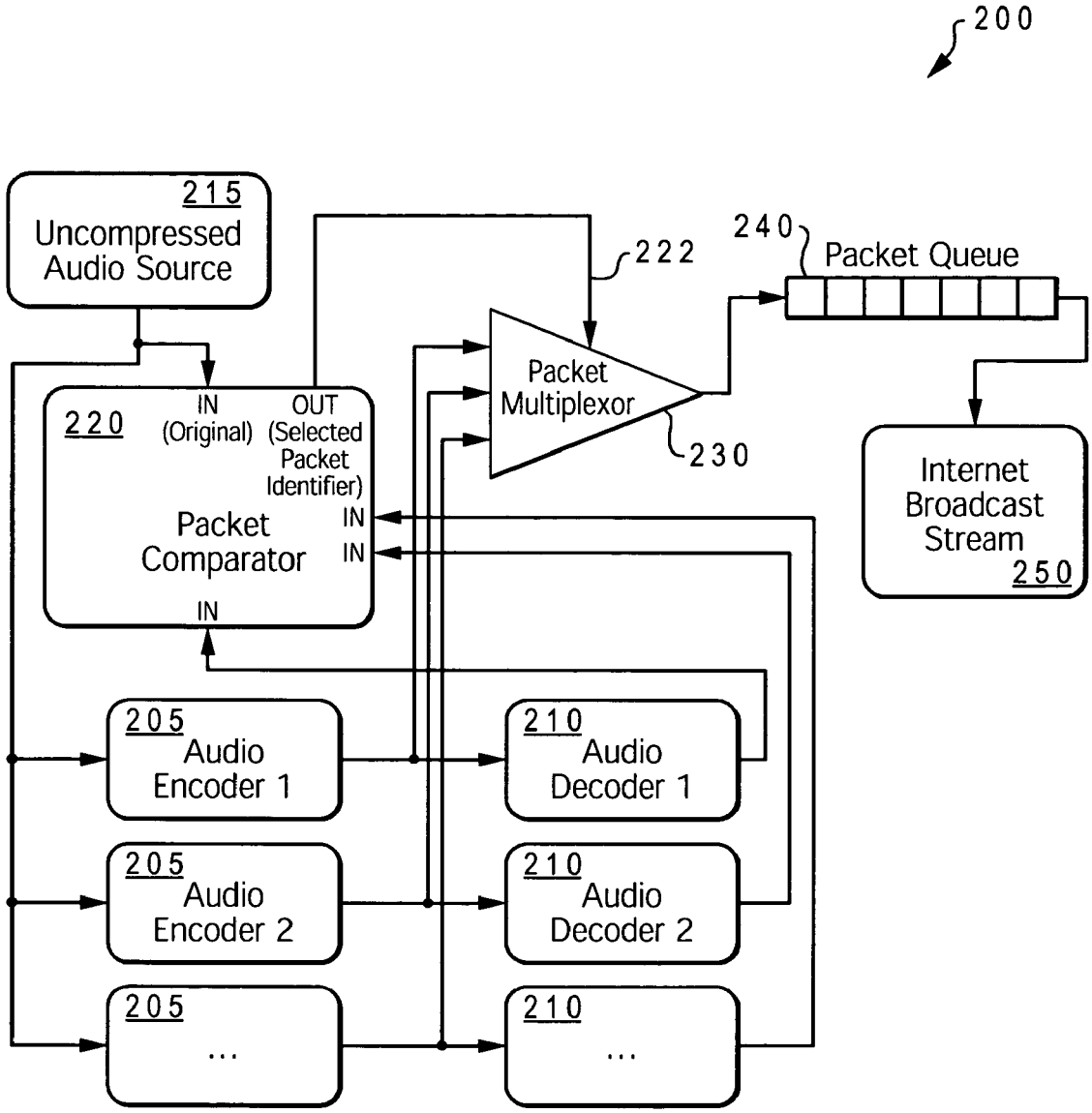
FIG. 2A is a block diagram of an exemplary broadcast system configured according to one embodiment of the invention.

FIG. 2A illustrates an exemplary broadcast system having software and/or hardware logic to complete transmission of a stream of audio (or other media) content according to the method and process described herein. Broadcast system 200 includes several functional components, which include more than one (i.e., at least two) encoders 205, an equal number of associated decoders 210, an audio source 215 with streaming audio content, and a multiplexer (MUX) 230. The audio source 215 contains uncompressed audio content which may be either voice or non-voice content or a combination of both. In the described embodiment, the original audio content exists at full bit rate and is uncompressed at the broadcast source. The function of the broadcast system 200 is to produce and broadcast an encoded version of this audio content, which, when decoded, most closely resembles the original audio content in terms of quality, while minimizing bandwidth usage.

Figure 2B:
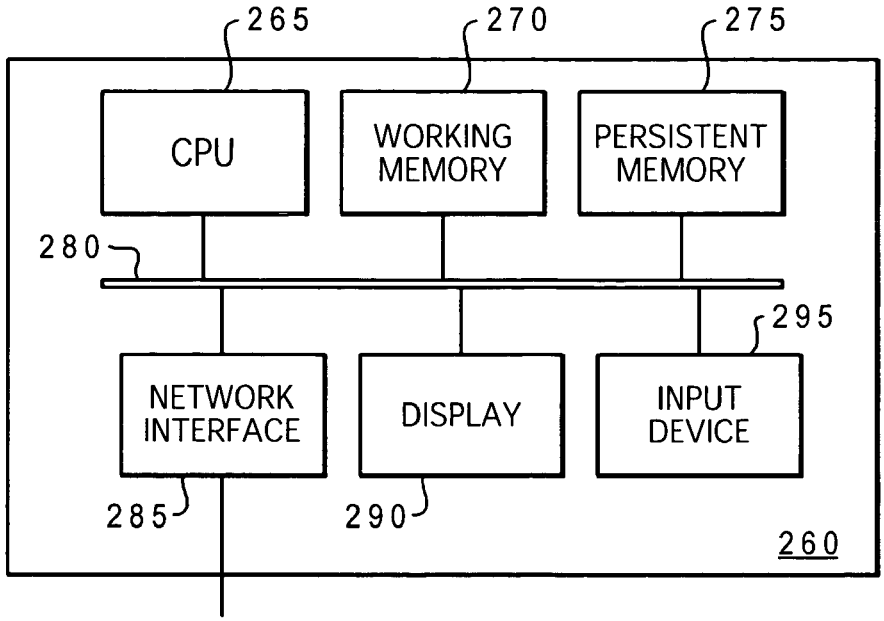
FIG. 2B is a block diagram of an exemplary processing system utilized to implement the various processing features of one or more of the modules provided within FIG. 2A (and FIG. 4) according to one embodiment of the invention.

FIG. 2B depicts interconnect component parts of an exemplary processing system that may advantageously be utilized to provide the processing features/functions of one or more of the functional blocks of FIG. 2A. For example, the functions of the packet comparator 220 may advantageously be implemented as software utility executing on the processor of processing system 260. Processing system 260 includes processor ("CPU") 265, working memory 270, persistent memory 275, network interface 285, monitor/display 290 and input/output (I/O) device 295, all communicatively coupled to each other via system bus 280. Processor 265 is capable of executing software stored in persistent memory 275. Working memory 270 may include random access memory ("RAM") or any other type of read/write memory devices or combination of memory devices. Persistent memory 275 may include a hard drive, read only memory ("ROM") or any other type of memory device or combination of memory devices that can retain data after processing system 260 is shut off. Input device 295 includes a keyboard, mouse, or other device for inputting data, or a combination of devices for inputting data. Network interface 285 may be utilized to provide a connection by processing system 260 to an external network (such as the Internet) on which the receiving system is located.

One skilled in the art will recognize that the exemplary processing system 260 may also include additional devices, such as network connections, additional memory, additional processors, LANs, input/output lines for transferring information across a hardware channel, the Internet or an intranet, etc. Also, one skilled in the art will recognize that the specific configuration of components is not meant to imply any limitations on the actual system utilized to perform the processes of the invention. Processing system 260 may be provided as a system on a chip (SoC) or as a simple set of logic components that together provide the functionality required for processing the audio content. Notably, in addition to the above described hardware components, processing system 260 also comprises software components that enable the various functions provided by the invention. Thus, in one embodiment, a codec-and-compare module/utility may be provided as program application/code within processing system 260.

Figure 2C:
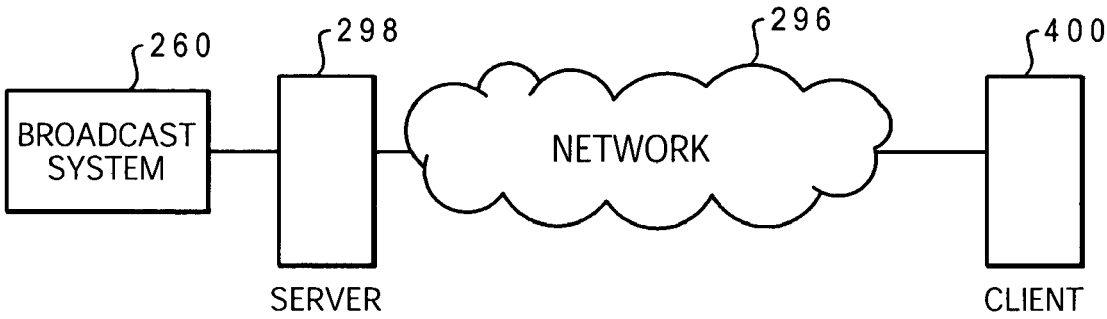
FIG. 2C illustrates an exemplary Internet network within which the broadcast features of the invention may advantageously be implemented in accordance with one embodiment of the invention.

FIG. 2C illustrates an exemplary Internet network within which the broadcast features of the invention may advantageously be implemented. As indicated, network comprises a broadcast system 260, connected to the Internet 296 via a server 298. Also connected to the Internet is a client/receiver system 400, which is described below. While features of the invention are described from the perspective of streaming Internet audio content, the invention is applicable to any type of media content being transmitted/broadcasted, including content for radio and television broadcasted via radio waves, etc. The specific reference to Internet transmission is not meant to be limiting on the invention.

Figure 3:
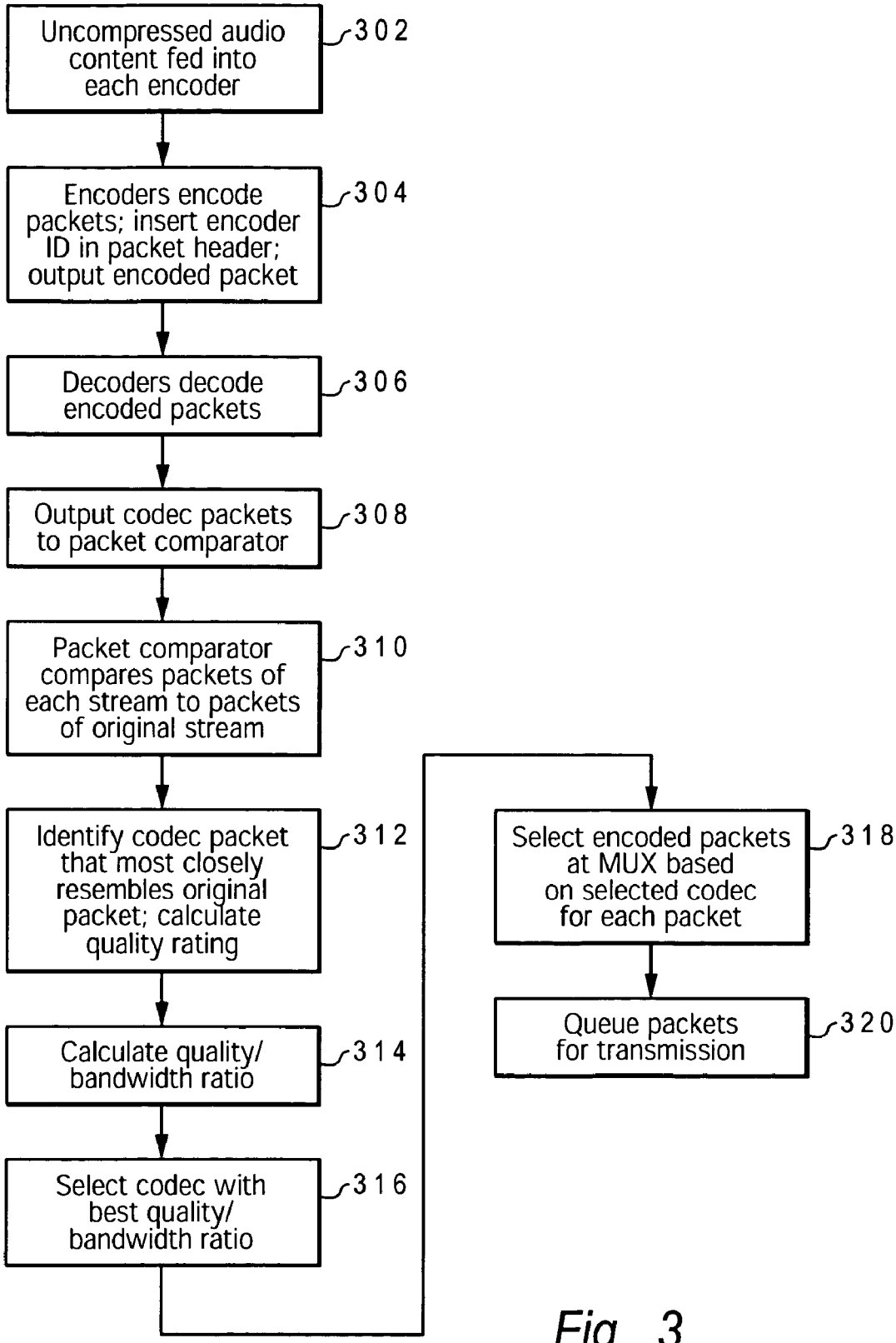
FIG. 3 is a flow chart of the process by which the audio codec processing is completed at the broadcast system of FIG. 2A in accordance with one embodiment of the invention.

FIG. 3 illustrates the process of evaluation and selection by the broadcast system of the encoded packet(s) for transmission. At block 302, the uncompressed audio content is sent from the audio source 215 to each of the two or more encoders 205. During the encoding by encoders 205, the identifier (ID) of the particular encoder (or the codec ID) is encapsulated within the packet header. At block 304, each of multiple encoders 205 at the broadcast source 200 encode the packets of the audio content and outputs the individual packets with the encoder identifier (EID) encapsulated therein. Notably, each encoding performed by a different encoder (and associated decoding) produces a different output packet with respect to encoded content and EID. The EID may be synonymous with the codec ID in alternate embodiments.

Packets from the encoders are then sent through associated decoders 210, where the encoded packets are immediately decoded, as indicated at block 306. These decoded packets from each decoder are then forwarded to packet comparator 220 at block 308. The packets' headers are still tagged with the respective EIDs. Packet comparator 220 receives as input a copy of the original uncompressed audio content (packets) from the audio source 215 and each of the compressed then decompressed (codec) audio streams (packets) from each of the decoders 210. At block 310, packet comparator 220 compares each corresponding packet from the audio decoders 210 against the original packet from the uncompressed audio stream. During this comparison, packet comparator 220 utilizes known comparative analysis to determine which of the streams is closest to the original audio content, and packet comparator calculates a quality rating from each packet/codec at block 312.

Various techniques exist that can be employed to quantify the degree to which an encoded stream resembles the original stream. In one implementation, software coded models of human perception are to perform objective measurements on audio quality. The techniques involved, as well as the development of these software models, are described at worldwide web (www) site www.psytech nics.com/papers, relevant content of which is incorporated herein by reference.

In another embodiment, the encoded packets are compared not only to the original packets, but also to a predefined, arbitrary model of human audio perception. For example, the model may define audio that is "low/unacceptable quality" as audio having certain characteristics (patterns, data conformancies, spikes, etc.) that are illustrative of audio that may sound metallic, garbled, etc. In one implementation, the present analysis comparing the audio content against the arbitrary model is completed entirely independent of the source audio packets. However, in a second implementation, the present analysis is completed in conjunction with the analysis utilizing the original packets as a way to "calibrate" the two analysis/algorithms.

Returning to FIG. 3, once the comparison is completed and the packet comparator 220 identifies the quality of each packet compared to the corresponding packet in the original audio content, a ratio is taken of the quality rating of the packet/codec against the bandwidth consumed by the specific codec, as shown at block 314. The selection module then utilizes this resulting ratio to select the codec that is optimal (i.e., the result that maximizes the quality/bandwidth ratio), as shown at block 316. The encoded packet generated by the encoding associated with the codec that produces the optimal result (according to this ratio) is then selected (from the other corresponding encoded packets) by the broadcast system. This selection occurs at the MUX 230. The packet comparator 220 issues an output signal 222 to packet MUX 230 with the specific EID identified.

Output signal 222 operates as a select signal for packet MUX 230, which receives as input an encoded packet from each of the audio encoders 205 encapsulated with a particular EID. As shown at block 318, the packet produced by the encoder with the selected EID is chosen from among the other corresponding packets. At block 320, the selected packet is added to an output queue 240 for broadcast over the Internet as a packet within an Internet broadcast stream 250.

Figure 4:
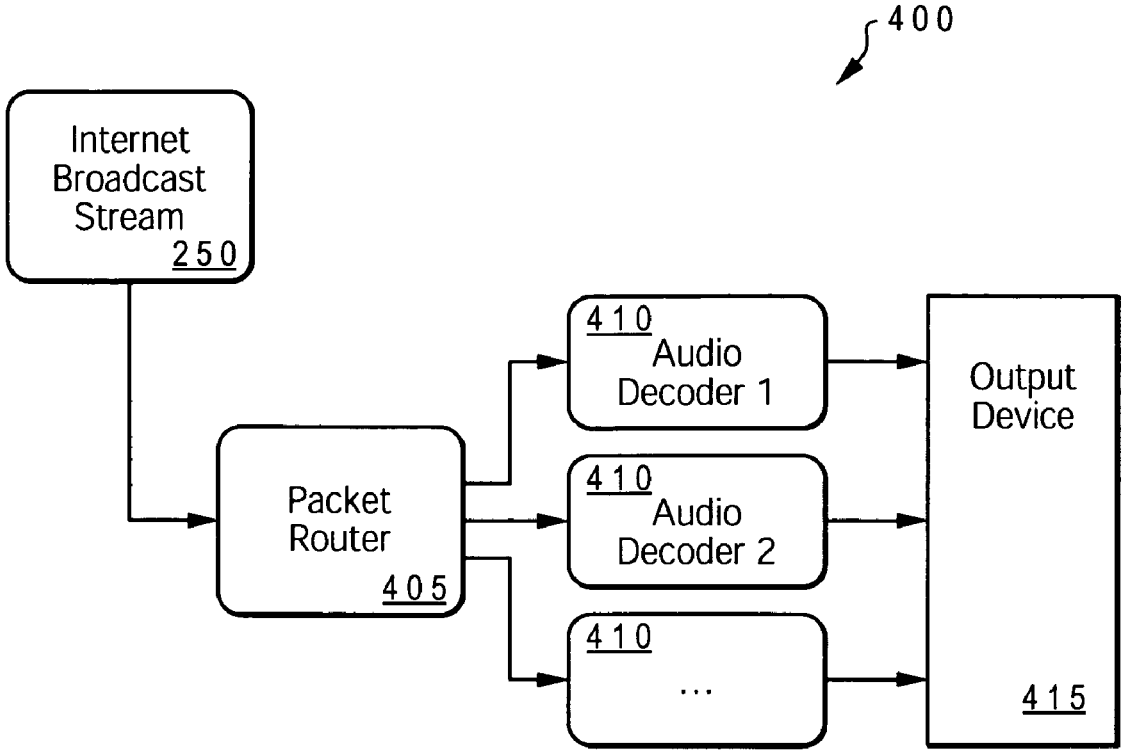
FIG. 4 is a block diagram of a receiving system designed to receive audio content from a broadcast system similar to that of FIG. 2A according to one embodiment of the invention.
Figure 5:
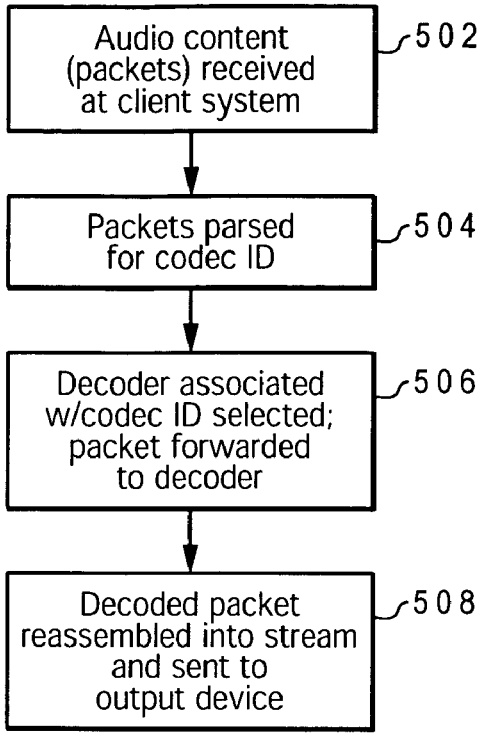
FIG. 5 is a flow chart of the process by which the transmitted packets are received and processed at the receiving system of FIG. 4 in accordance with one embodiment of the invention.

FIGS. 4 and 5 illustrate the client/receiver system of the transmission of the selected audio codec packets. As shown by FIG. 4, the client system includes a packet router 405, which receives Internet broadcast stream 250 from the Internet and reads the EID to determine which decoder the packet should be forwarded to. For purposes of the invention, the client system may actually be a web server that provides the content within a browser application utilized to access the server via the server's URL.

Each client system has a plurality of decoders 410, which, according to the invention, are similar to decoders 210 of the broadcast module. Each decoder is associated (in codec processing terms) to one of the encoders 205 that encodes the audio content. Coupled to the output of each decoder 410 is an output device 415 that outputs the transmitted codec version of the original audio content.

FIG. 5 illustrates the processes at the client system beginning with transmission of a selected audio content via the Internet. Client system receives the stream of packets at block 502, and at block 504, packet router 305 parses the packet header of each packet for the EID that identifies the particular codec used for the packet. The EID identifies the correct decoder for that packet, and at block 506, the packet is forwarded to the corresponding decoder. Thus, when multiple packets with different codec EIDs are received, each packet is forwarded to a different decoder. Once decoded, the packets are then sent to output device at block 508 where they are re-assembled relative to each other to re-constitute the transmitted audio stream.

According to the illustrative embodiment, the comparison is performed on a packet-by-packet basis, and the broadcast source selects the codec that performs the best for the audio in a given packet. However, while the illustrative embodiment is described on a packet-by-packet basis, other types of analysis are contemplated, particularly for audio codec formats that are not structured as individual packets. For example, when dealing specifically with the Ogg container format, consideration is given to the structure of the packet streams. Logical Ogg streams consist of distinct pages of data.

Figure 1B:
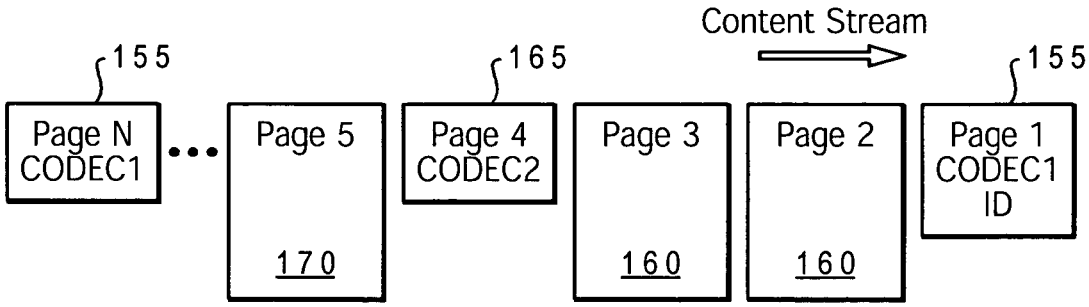
FIG. 1B illustrates exemplary audio content transmitted as page content with preceding codec page according to one implementation of the invention.

FIG. 1B illustrates an exemplary Ogg stream with pages representing the coded ID 155, 165 followed by the pages of audio content 160, 170, respectively. As shown, the first page 155 in the stream serves only as the codec identifier for the data contained in the pages to follow 160. With the process of the invention applied to Ogg, separate pages (e.g., page 165) are inserted into the stream to flag the switching of the codec used in subsequent pages 170.

Figure 6:
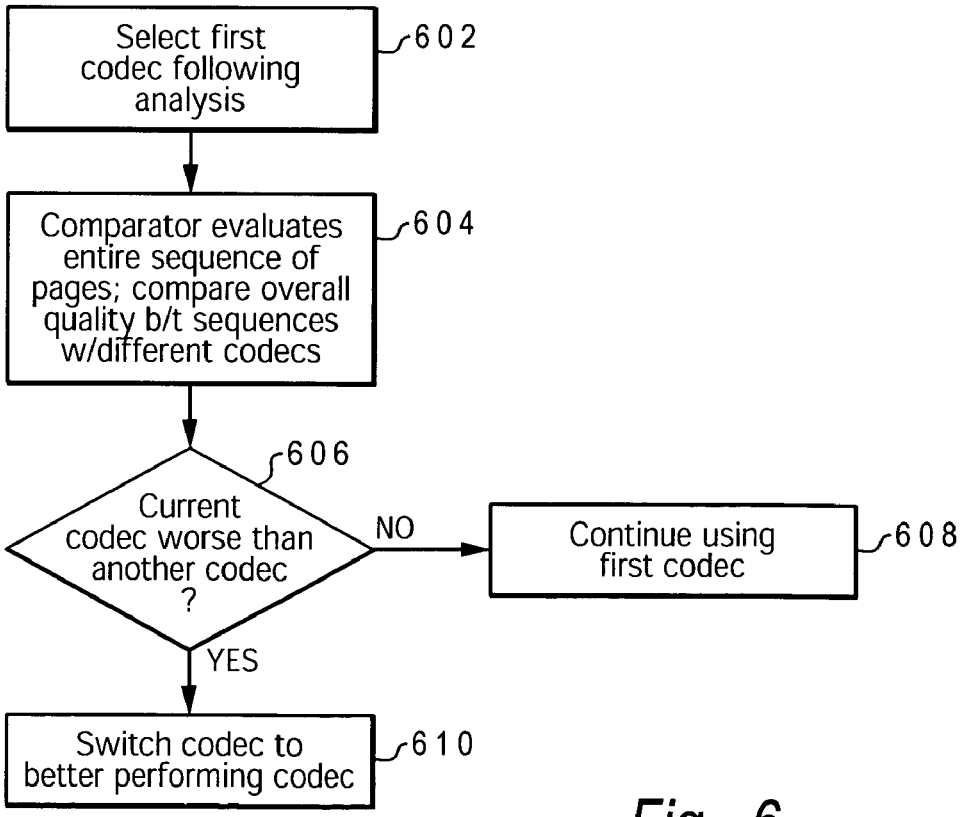
FIG. 6 is a flow chart illustrating the process of transmitting pages (rather than packets) according to one embodiment of the invention.

Since audio streams switch between voice and music relatively infrequently, the broadcaster's comparator operates in a stateful manner most of the times. Notably, in this embodiment, if the optimum codec switches too rapidly, then bandwidth is lost due to the overhead for these codec ID pages. FIG. 6 illustrates one method provided to mitigate the potential overhead issues that may arise with this implementation. Notably, the broadcast system of FIG. 2B is configured to allow page sized codec and comparisons (rather than packet-by-packet) and the codec page preceding the pages replaces the EID placed in packet headers during the packet-by-packet analysis. With this implementation, the overhead that would be otherwise incurred by including the codec identifier with each and every packet being transmitted is effectively reduced.

Beginning at block 602, a first codec is selected for the first page (or group of pages) based on the analysis at the comparator. As shown at block 604, the comparator evaluates entire sequences of pages and compares the overall quality between sequences encoded by different codecs. A determination made at block 606 whether the currently selected broadcast codec performs worse (within a given time frame) than another identified codec. If no other codec performs better than the currently selected codec, then the codec continues to be utilized as shown at block 608. However, if the currently selected broadcast codec performs worse than another codec for over a pre-determined, extended period of time (pre-selected during design/configuration of the system), the broadcast system switches the codec used for the pages to the other, better-performing codec, as indicated at block 610.

As a final matter, it is important that while an illustrative embodiment of the present invention has been, and will continue to be, described in the context of a fully functional computer system with installed management software, those skilled in the art will appreciate that the software aspects of an illustrative embodiment of the present invention are capable of being distributed as a program product in a variety of forms, and that an illustrative embodiment of the present invention applies equally regardless of the particular type of signal bearing media used to actually carry out the distribution. Examples of signal bearing media include recordable type media such as floppy disks, hard disk drives, CD ROMs, and transmission type media such as digital and analogue communication links.

While the invention has been particularly shown and described with reference to a preferred embodiment, it will be understood by those skilled in the art that various changes in form and detail may be made therein without departing from the spirit and scope of the invention. For example, while the described embodiments of the invention refer specifically to audio content and audio frames, the present invention finds applicability to any media that is transmitted from a source to a destination and which may utilize different codecs, which each yield different transmission quality and bandwidth.

What is claimed is:

1. A broadcast system comprising:

a plurality of encoders providing different encoding of an original audio content, said encoders receiving as input the original audio content from a source and outputting respective versions of encoded audio content;

a plurality of decoders each associated with the one of the plurality of encoders and receiving as input one of the versions of encoded audio content from the associated encoder, wherein the decoders decode the received version of encoded audio content to provide corresponding decoded audio content; and a comparator that receives as input the audio content decoded by each of the plurality of decoders and the original audio content and which compares each of the decoded audio content with the original content and selects the encoded audio content of the encoder associated with the decoder whose decoded audio content most closely resembles the original audio content based on the comparison, wherein the selected encoded audio content is selected for transmission from the broadcast system from among the versions of encoded audio content produced by the plurality of encoders;

wherein the comparator completes the selection of audio content and associated encoder-decoder pair via a series of processes including:

determining which decoded audio content most closely resembles the original audio content in quality; and calculating a quality-to-bandwidth ratio using the quality of each encoded audio content over the bandwidth required for transmission of the corresponding encoded audio content.

2. The broadcast system of claim 1, further comprising:

a multiplexer (MUX) that receives as data inputs each of the encoded audio content from respective ones of the plurality of encoders and receives as select input an output from the comparator indicating which one of the encoded audio content to transmit, wherein said MUX outputs the selected encoded audio content and discards all other ones of the encoded audio content;

wherein only the selected version of encoded audio content that, when decoded, produces a best match to the original audio content is transmitted.

3. The broadcast system of claim 2, further comprising a transmission queue that queues each selected, encoded audio content for transmission as a part of a broadcast stream.

4. The broadcast system of claim 2, further comprising a transmission system that enables broadcast of the selected audio content over the Internet, wherein said selected audio content is broadcasted within an Internet audio stream.

5. The broadcast system of claim 1, wherein:

the audio content is packetized audio content, such that each encoding is performed on an audio packet, wherein said encoder further encapsulates a corresponding encoder ID (EID) within the header of each encoded audio packet; and the output from the comparator includes the EID of the selected encoded audio packet.

6. The broadcast system of claim 1, wherein further the comparator completes the selection of an audio content and associated encoder-decoder pair via a series of processes including:

selecting an audio content yielding a best quality-to-bandwidth ratio as the optimal encoded audio content to transmit; and identifying the encoder-decoder pair that produces and decodes the optimal encoded audio content.

7. The broadcast system of claim 1, further comprising:

comparing the encoded audio content to a predefined, arbitrary model of human audio perception, wherein said model defines audio based on specific characteristics, such as patterns, data conformances, and spikes, which characteristics are illustrative of audio that is not of good quality.

8. The broadcast system of claim 7, further comprising calibrating said comparator by concurrently completing analyses of said encoded audio content against both the original audio content and the predefined, arbitrary model of human audio perception.

9. The broadcast system of claim 6, wherein said selecting feature further comprises:

parsing a header of the selected audio content for the EID; and including the EID within the output which selects the audio content.

10. The broadcast system of claim 1, wherein:

the transmitted audio stream is in page format with a first, preceding page identifying the codec ID and following pages providing the encoded audio content;

changes in the encoding is identified by adding a different codec ID page before the new content pages;

said encoding encodes the codec ID within the preceding pages and said parsing occurs on said preceding pages to identify the EID utilized to generate the encoded audio content on the following pages; and said comparator evaluates an entire sequence of pages following the codec ID page for quality against the original audio content and switches the codec only when a next codec performs better over the sequence than the current codec.

11. A computer program product comprising:

a computer readable recording medium; and program instructions on the computer readable medium for providing a plurality of functional modules including:

a plurality of encoders providing different encoding of an original audio content, said encoders receiving as input the original audio content from a source and outputting respective versions of encoded audio content;

a plurality of decoders each associated with the one of the plurality of encoders and receiving as input one of the versions of encoded audio content from the associated encoder; and a comparator that receives as input the audio content decoded by each of the plurality of decoders and the original audio content and which selects the encoded audio content of the encoder associated with the decoder whose decoded audio content most closely resembles the original audio content, wherein the selected encoded audio content is selected for transmission from the broadcast system;

wherein the comparator completes the selection of an audio content and associated encoder-decoder pair via a series of processes including:

determining which decoded audio content most closely resembles the original audio content in quality; and calculating a quality-to-bandwidth ratio using the quality of each encoded audio content over the bandwidth required for transmission of the corresponding encoded audio content.

12. The computer program product of claim 11, wherein said functional modules provided by program instructions further comprises:

a multiplexer (MUX) that receives as data input each of the encoded audio content from respective ones of the plurality of encoders and receives as select input an output from the comparator indicating which one of the encoded audio content to transmit, wherein said MUX outputs the selected encoded audio content and discards all other ones of the encoded audio content.

13. The computer program product of claim 12, further comprising program code for implementing a transmission queue that queues each selected, encoded audio content for transmission as a part of a broadcast stream.

14. The computer program product of claim 12, further comprising program code for enabling a transmission system to broadcast the selected audio content over the Internet, wherein said selected audio content is broadcasted within an Internet audio stream.

15. The computer program product of claim 11, wherein the audio content is packetized audio content, such that each encoding is performed on an audio packet, wherein said encoder further encapsulates a corresponding encoder ID (EID) within the header of each encoded audio packet; and the output from the comparator includes the EID of the selected encoded audio packet.

16. The computer program product of claim 11, wherein further the comparator completes the selection of an audio content and associated encoder-decoder pair via a series of program instructions including instructions for:

selecting an audio content yielding a best quality-to-bandwidth ratio as the optimal audio content to transmit.

17. The computer program product of claim 11, further comprising instructions for comparing the encoded audio content to a predefined, arbitrary model of human audio perception, wherein said model defines audio based on specific characteristics, such as patterns, data conformances, and spikes, which characteristics are illustrative of audio that is not of good quality.

18. The computer program product of claim 17, further comprising instructions for calibrating said comparator by concurrently completing analyses of said encoded audio content against both the original audio content and the predefined, arbitrary model of human audio perception.

19. The computer program product of claim 13, wherein said program instructions for completing the selecting feature further comprises instructions for:

parsing a header of the selected audio content for the EID; and including the EID within the output which selects the audio content.

20. The computer program product of claim 11, further comprising program code for providing functional modules for a receiving system including:

a plurality of receiving-end decoders that are substantially similar to the decoders and which are each identified with an EID of a corresponding encoder within a broadcast system, wherein received audio content with that EID is decoded by the decoder with corresponding EID;

a router that parses a header of each received audio content for the EID and routes the audio content to the particular receiving-end decoder identified by the EID; and a reconfiguring module that reassembles the audio content relative to other received audio content into the original stream of audio content following decoding of the audio content by the plurality of receiving-end decoders, and which forwards the reassembled audio content to an audio output device.

21. A method comprising:

encoding an original media content with a plurality of different encoders to generate a plurality of differently-encoded media content;

decoding the plurality of differently-encoded media content via a plurality of decoders, each associated with a respective one of the plurality of different encoders, wherein said decoding produces codec versions of the original media content;

determining a most optimal codec from among the codec versions when compared to the original media content, said determining comprising (i) determining a quality of each of the codec versions compared to the original media content, and (ii) calculating a ratio of the quality of each codec version against the bandwidth required for transmission of its associated differently-encoded media content; and broadcasting a selected one of the differently-encoded media content that is associated with a codec version, which yields a most optimal codec for the original content, wherein the other differently-encoded media content are not broadcasted;

wherein said broadcasting comprises selecting the encoded media content corresponding to the codec version that produced a best ratio of quality against bandwidth.

22. The method of claim 21, wherein said encoding further comprises encapsulating an encoder ID (EID) within the encoded media content, wherein the EID is utilized during later selection of said encoded media content for transmission and during decoding of said encoded media content at a receiving end of the transmission.

23. The method of claim 22, wherein:

said encoding further comprises encoding a first page of a page format transmission of media content with the EID; and wherein said determining includes comparing a sequence of pages following the first page to determine which codec yields a best quality output when compared to the original media content, and selecting the codec yielding the best quality output for each of the following pages of media content.

* * * * *